United States Patent [19]

Owen

[11] Patent Number: 4,524,341

[45] Date of Patent: Jun. 18, 1985

[54] TRANSFORMER WITH SERIES-PARALLEL-SERIES WINDING BETWEEN SPLIT WINDING

[76] Inventor: Donald W. Owen, 4619 Ridgeline Dr., Norman, Okla. 73069

[21] Appl. No.: 464,779

[22] Filed: Feb. 7, 1983

[51] Int. Cl.[3] ..... H01F 21/12

[52] U.S. Cl. ..... 336/147; 336/145

[58] Field of Search ..... 336/145, 146, 147, 171, 336/181, 183; 323/340, 346, 348

[56] References Cited

U.S. PATENT DOCUMENTS

| | | | |
|---|---|---|---|
| 726,391 | 4/1903 | Armstrong et al. . | |
| 742,926 | 11/1903 | Stuart | 336/146 |
| 1,291,078 | 1/1919 | Moody . | |
| 1,632,097 | 6/1927 | Peters . | |
| 1,993,794 | 3/1935 | Meyerhans . | |
| 2,464,061 | 3/1949 | Soley, Jr. . | |
| 2,713,667 | 7/1955 | Schwennesen | 336/183 |
| 2,791,646 | 5/1957 | Keroes | 336/183 X |
| 2,990,524 | 6/1961 | O'Meara et al. . | |
| 3,083,331 | 3/1963 | Spurway . | |
| 3,144,628 | 8/1964 | Rabins | 336/147 X |
| 3,182,248 | 5/1965 | McNamee . | |
| 3,349,320 | 10/1967 | Mathes . | |
| 3,484,727 | 12/1969 | Weber et al. . | |
| 3,619,764 | 11/1971 | Brennan . | |
| 3,675,175 | 7/1972 | Dutton . | |
| 3,725,833 | 4/1973 | Thomas . | |
| 3,891,955 | 6/1975 | Horton . | |
| 3,895,335 | 7/1975 | Manimalethu | 336/183 |
| 4,160,224 | 7/1979 | Owen . | |
| 4,255,734 | 3/1981 | Owen . | |
| 4,256,932 | 3/1981 | Owen . | |
| 4,300,112 | 11/1981 | Leibinger et al. | 336/180 |

*Primary Examiner*—Reinhard J. Eisenzopf

*Attorney, Agent, or Firm*—E. Harrison Gilbert, III

[57] ABSTRACT

A transformer includes a core upon which a plurality of electrical conductors are concentrically disposed. The innermost and outermost electrical conductors are electrically connected to define a first winding, and the remaining electrical conductors are associated as one or more pairs of subwindings to define one or more additional windings. The association of each pair of subwindings is made by a suitable mechanism by which sections of the subwindings can be connected in electrical parallel, which paralleled sections are spaced equal total distances from the two portions of the first winding.

20 Claims, 6 Drawing Figures

TRANSFORMER WITH SERIES-PARALLEL-SERIES WINDING BETWEEN SPLIT WINDING

BACKGROUND OF THE INVENTION

This invention relates generally to electrical transformers and more particularly, but not by way of limitation, to an electrical transformer having one winding split into two parts which have one or more additional windings radially disposed therebetween, the additional winding or windings having sections connectable in parallel, which sections when in parallel are spaced equal total radial distances from the two parts of the split winding.

In U.S. Pat. No. 3,083,331 to Spurway, it is disclosed that a transformer is to be constructed so that corresponding sections of the windings have equal "leakage impedances." Having equal leakage impedances (more correctly, leakage reactances) is a desirable criterion for a transformer because losses are thereby reduced; however, the attainment of such a criterion requires a relatively complex manufacturing process for constructing the transformer. For example, equal leakage reactance requires that the number of turns in each winding section be equal, the occupied space of each section be equal, the turn lengths be equal, and the primary/-secondary spacing be equal.

In U.S. Pat. No. 4,160,224 to Owen there is disclosed a transformer which can be more easily manufactured than the Spurway transformer; however, the transformer disclosed in the Owen patent does not have equal leakage reactances. Despite the unequal leakage reactances and contrary to the disclosure in the Spurway patent that leakage reactances must be equal, the transformer disclosed in the Owen patent is operable. Although the transformer disclosed in the Owen patent is functional, it operates with relatively increased losses due to the unequal leakage reactances. The tradeoff for these losses is a more easily manufacturable, and thus likely less expensive, transformer.

The transformer disclosed in the Owen patent includes axially spaced, side-by-side subwindings having electrically parallelable sections which are spaced different radial distances from the other windings. These windings are co-directionally wound for easier fabrication, but they are disposed so that some measurable amount of loss occurs due to the unequal leakage reactances. Additionally, the side-by-side construction of the windings causes the transformer to have a relatively weaker short-circuit strength because significant axial forces can be developed as a result of such offset design of the paralleled sections (and also the corresponding offset design of any remaining seriesed sections). These axial forces have a destructive telescoping effect on the transformer windings and are not as easily containable as are radial forces.

Although it is known that a relatively easily manufacturable transformer having unequal leakage reactances can be functional, it is desirable to construct an improved transformer which reduces the losses caused by the unequal leakage reactances and which reduces or prevents the destructive axial forces arising during short-circuit conditions. It is further desirable to achieve these ends while still retaining a transformer which is relatively easily manufactured.

SUMMARY OF THE INVENTION

The present invention overcomes the above-noted and other shortcomings of the prior art by providing a novel and improved transformer. This transformer has a construction which may be relatively easily manufactured and yet more closely approaches the desirable criterion of equal leakage reactances disclosed in the Spurway patent. The present invention also has a construction in which relatively small or no axial forces are created during a short-circuit condition.

Broadly, the transformer of the present invention comprises first winding means having a first portion and a second portion and a second winding means having a plurality of sections selectively connectable in electrical parallel so that a first parallel segment and a second parallel segment are defined when at least two of the sections are connected in electrical parallel. The second winding means is disposed in inductive relationship with the first winding means between the first portion and the second portion of the first winding means so that the first parallel segment and the second parallel segment are equally spaced from the first winding. Furthermore, the paralleled sections (as well as the other sections and windings) are concentric with each other so that a force arising from a short-circuit current acts substantially only radially on the windings.

Therefore, from the foregoing, it is a general object of the present invention to provide a novel and improved transformer. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

With reference to the drawings, there will be described a transformer constructed in accordance with the preferred embodiment of the present invention. The transformer includes a core 2 about which a plurality of windings 4 is wrapped. Interleaved among the windings is a plurality of section tap leads 6 extending from, and defining, a plurality of sections. Also extending from the windings 4 is a plurality of energization leads by which energy is applied to and removed from the transformer. In particular, the energization leads include electrical conductors 8*a*, 8*b* by means of which a voltage source is connected to the primary winding of the transformer. The energization leads also include two pairs of leads 10*a*, 10*b* and 12*a*, 12*b* by means of which the electrical outputs from two secondary windings of the illustrated transformer are connected to one or more loads.

The core 2 of the preferred embodiment includes two iron core halves 14, 16 abutting each other and being constructed in a conventional manner as known to the art. Each of these core halves 14, 16 has an opening through which the windings 4 extend. The cores can be constructed so that each half is separable to enable each core half to be fit around the windings 4 which can be first wound on a mandrel as known to the art. Other suitable cores may be used. A core other than an air core is generally utilized to provide means upon which the windings can be mounted for enhancing the inductive coupling of the windings.

Figure 3:
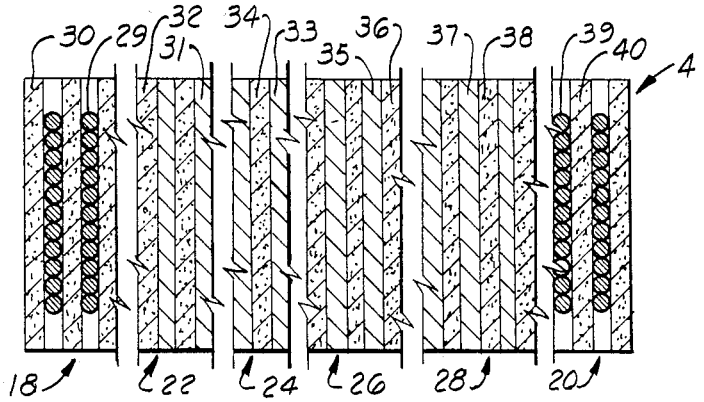
FIG. 3 is a partial sectional view taken along line 3—3 shown in FIG. 1.

The windings 4 of the preferred embodiment are shown in FIG. 3 to include a first winding comprising a first portion 18 and a second portion 20. The windings 4 also include a second winding having a first subwinding 22 and a second subwinding 24. Also included in the windings 4 is a third winding having a third subwinding 26 and a fourth subwinding 28.

Each of the windings 4 of the preferred embodiment includes an electrical conductor 29, 31, 33, 35, 37 or 39, respectively, which is co-directionally wound relative to a central opening of the windings through which the interior legs of the core halves 14, 16 extend. The co-directional winding of each of the electrical conductors creates concentric layers which are insulated from adjacent layers by suitable insulating means such as insulating paper 30, 32, 34, 36, 38, 40. The winding of each conductor occurs co-directionally, but sequentially, so that initially the first portion 18 is wound, then the subwinding 22, and so on. In the preferred embodiment the electrical conductor of the first portion 18 is wrapped adjacent the core 2 so that the conductor extends about the core in radially disposed convolutions. Subsequent windings of the preferred embodiment are built upon and adjacent each preceding winding or part thereof. It is to be noted that in the illustrated preferred embodiment, the electrical conductors 29 and 39 are insulated round conductors and the electrical conductors 31, 33, 35 and 37 are electrically conductive sheets; however, other types (e.g., rectangular strap conductors) of conductors can also be used for any of the conductors 29–39. FIG. 3 illustrates that each of the conductors 29 and 39 is wound spirally within each layer and that each layer is concentric with each other layer.

Figure 1:
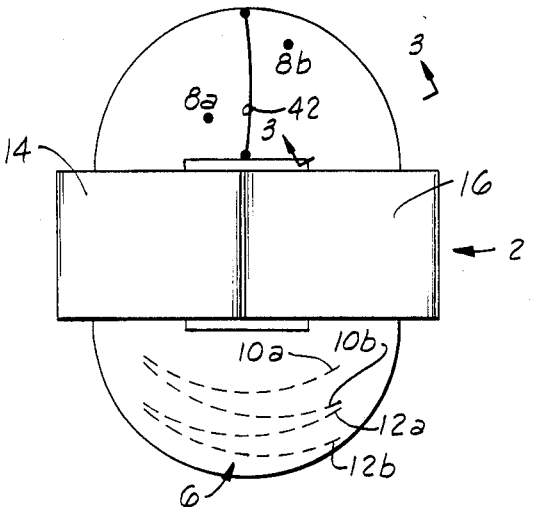
FIG. 1 is an end view of a schematic illustration of the preferred embodiment of the present invention.
Figure 2:
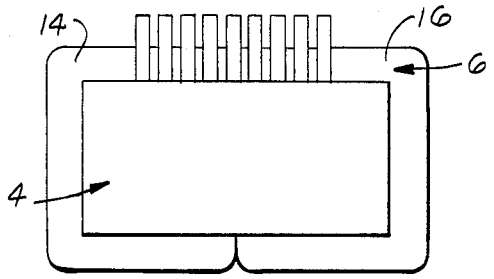
FIG. 2 is a side view of the schematic illustration of the preferred embodiment of the present invention.

The tap leads 6 of the preferred embodiment shown in FIGS. 1 and 2 are constructed of electrically conductive straps which are suitably disposed at predetermined locations within each of the subwindings 22–28. These straps, or section leads, are inserted at the proper locations during the operation of co-directionally winding the electrical conductors of the windings 4.

As shown in FIG. 3, each of the winding portions and subwindings of the group of windings 4 is disposed radially relative to each other winding portion or subwinding, but each is not axially spaced, or offset, from each other. The construction of the windings 4 of the preferred embodiment will be more particularly described with reference to FIG. 4.

Figure 4:
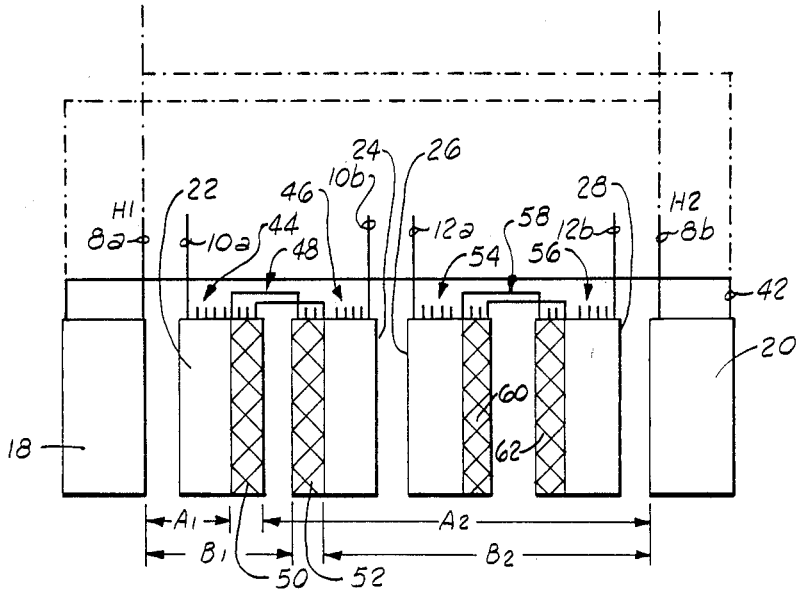
FIG. 4 is a schematic diagram of the windings of the present invention showing paralleled sections and the radial relationship of the windings.

FIG. 4 schematically shows the two portions and four subwindings of the group of windings 4. As viewed in FIG. 4, to the left of the portion 18 of the first winding is the innermost portion of the core 2 (not shown); therefore, as viewed in FIG. 4, "radially inwardly" is in a direction toward the left and "radially outwardly" is in a direction to the right. "Radial" itself refers to the left and right, or horizontal, direction as viewed in FIG. 4. Thus, the portion 20 of the first winding is spaced radially outwardly from the portion 18 of the first winding.

As illustrated in FIG. 4 (and also shown in FIG. 1), the two portions 18, 20 of the first winding are electrically connected by a suitable conductor 42. In the preferred embodiment the portions 18 and 20 constitute the primary winding of the transformer; however, the present invention also applies to a split secondary winding. That is, in the preferred embodiment, the portions 18, 20 constitute the primary of the transformer and the subwindings 22, 24 and 26, 28 constitute two secondaries of the transformer; however, the present invention is also applicable to transformers in which the secondary or secondaries are radially split around the primary or primaries.

Although the first winding is split into two portions 18 and 20, the first winding of the preferred embodiment is a single transformer winding in the sense that the transformer can be constructed so that neither of the portions 18 or 20 individually has sufficient turns to constitute a transformer winding which will not cause the core to saturate. That is, for a transformer winding to be properly functional, it must include a minimum number of turns to prevent the core from saturating when an electrical voltage is impressed across the winding. It is to be noted, however, that the present invention is not limited to a split winding wherein each portion has any specific minimum or maximum number of turns; the limitation in this regard is only that the two portions electrically connected together contain sufficient turns to permit proper operation of the transformer.

As best illustrated in FIG. 4, the energization lead 8*a* is connected toward the radially outwardmost part of the winding portion 18, whereas the energization lead 8*b* is connected near the radially inwardmost part of the winding portion 20. The electrical connection between the two winding portions 18, 20 is made between the radially inwardmost part of the winding portion 18 and the radially outwardmost part of the winding portion 20. This construction places the two portions in electrical series and permits co-directional current flow through the two winding portions 18, 20 which are co-directionally wound relative to the core 2.

The portions 18, 20 can be connected in other configurations. For example, the portions 18, 20 can be connected in electrical parallel by electrically connecting the energization lead 8*a* to the radially outwardmost part of the portion 20 and by electrically connecting the energization lead 8*b* to the radially inwardmost part of the portion 18. This is illustrated by the dot-dash lines in FIG. 4. As another example, suitable switch means can be used to selectably connect sections of the portions 18, 20 in various series-parallel-series configurations.

Disposed between the split portions 18, 20 of the first winding are both the subwindings 22, 24 of the second winding and the subwindings 26, 28 of the third winding. The subwinding 22 is disposed radially closer to the portion 18 than is any one of the other three subwindings. The subwinding 24 is disposed radially closer to the portion 18 of the first winding than is either the subwinding 26 or the subwinding 28. The subwinding 26 is disposed radially closer to the portion 18 of the first winding than is the subwinding 28. This relationship can also be stated with respect to a more radially outwardly disposed subwinding being more closely disposed relative to the portion 20 of the first winding than is a more radially inwardly disposed one of the subwindings. As also shown in FIG. 4, there is no axial displacement of the winding portions or subwindings relative to each other ("axially" being defined in an up and down, or vertical, direction as viewed in FIG. 4).

Disposed adjacent the first portion 18 of the first winding is the second winding including the subwindings 22, 24. Extending from predetermined locations of the subwinding 22 is a plurality 44 of the section leads 6. Extending from predetermined locations of the subwinding 24 is another plurality 46 of the section leads 6. In the preferred embodiment illustrated in FIG. 4, each of the pluralities 44, 46 of the section leads includes nine electrical conductors which define eight sections within each of the subwindings 22, 24; however, other numbers of sections can be used. Each of the sections includes one or more turns of the electrical conductor of which the respective subwinding of the preferred embodiment is constructed.

In the illustrated embodiment wherein the subwindings are constructed of sheet conductors, each "turn" defines a "layer" so that the sections of the illustrated embodiment can be equivalently defined in terms of either "turns" or "layers." However, if the subwindings were made of insulated round wire (such as that of which the portions 18, 20 are shown to be constructed) with two or more "turns" of wire defining a "layer," then a section could be defined either in terms of "turns" which thus might imply less than one complete layer or in terms of "layers" which would imply more than one "turn." Stated differently, a "turn" contemplates one loop of a conductor around the core, whereas a "layer" contemplates the collection of one or more "turns" of the conductor which are equidistant from the core or which are axially disposed at equal radial distances, and a "section" contemplates one or more "turns" which may or may not constitute one or more "layers." FIG. 3 shows two "layers" of the portion 18 with each "layer" having eleven "turns" of the conductor.

So that selectable ones of the sections can be connected in electrical parallel, the transformer of the present invention also includes suitable means for so connecting the sections. This means is schematically illustrated in FIG. 4 and identified by the reference numeral 48. This connecting means can be implemented by suitable switches such as are disclosed in U.S. Pat. No. 4,256,932 to Owen or my co-pending U.S. patent application Ser. No. 453,728, filed Dec. 27, 1982.

By suitably controlling the connecting means 48, selectable ones of the sections defined by the pluralities 44, 46 of the section leads can be connected in electrical parallel. More particularly, the connecting means 48 can be manipulated to connect selectable ones of the sections defined by the plurality 44 in electrical parallel with selectable ones of the sections defined by the plurality 46. For the configuration illustrated in FIG. 4, the radially outwardmost three sections of the subwinding 22 have been connected in electrical parallel with the radially inwardmost three sections of the subwinding 24. By suitably manipulating the connecting means 48, different combinations of the respective sections can be connected in electrical parallel as known to the art.

For those sections which are connected in electrical parallel, the paralleled sections of the subwinding 22 define a first parallel segment 50, and the paralleled sections of the subwinding 24 define a second parallel segment 52. For the preferred embodiment, the parallel segments are defined when at least two of the sections (i.e., at least one section from each of the subwindings 22, 24) are connected in electrical parallel. Because in the preferred embodiment each section includes at least one turn, or layer in this case, of the respective electrically conductive sheets, it can also be stated that each of the parallel segments of the preferred embodiment includes at least one of such turns or layers. Furthermore, in the preferred embodiment each of the turns or layers (and each of the illustrated electrically conductive sheets) has an equal thickness and each of the sections of the subwindings has an equal number of turns or layers; therefore, the two parallel segments 50, 52 have equal thicknesses, the thicknesses being defined as the radial lengths of the portions illustrated in FIG. 4 or other suitable segments of the parallel windings such as are defined by a plane passing through the portions 18, 20 and including the paralleled sections of the subwindings. In other embodiments of the present invention wherein each layer comprises more than one turn of the conductor (such as when the conductor is an insulated round wire), each turn has an equal thickness because the conductor has a constant diameter or thickness and each layer has an equal thickness because each layer has an equal number of turns of the conductor.

In the preferred embodiment the first and second parallel segments 50, 52 have equal cross-sectional areas because they have equal axial lengths in addition to equal radial lengths. Although the segments have equal cross-sectional areas, they do not have equal turn lengths or equal volumes because the parallel segment 52 is spaced radially farther from the common center of the windings than is the parallel segment 50. Because the present invention lacks equal turn lengths and equal volumes of the parallelable sections, the present invention does not have equal leakage reactances. However, the preferred embodiment of the present invention does have equal numbers of turns in each section and the parallel segments are equal total radial distances from the first winding; therefore, the leakage reactances are closer to being equal than those of the transformer disclosed in U.S. Pat. No. 4,160,224.

In the preferred embodiment the sections forming the parallel segments 50, 52 are those sections of one of the subwindings which are physically closest to the other subwinding. For the exemplary configuration illustrated in FIG. 4, the three sections of the subwinding 22 defining the parallel segment 50 are those three sections which are physically closest to the subwinding 24. Likewise, the three sections of the subwinding 24 defining the parallel segment 52 are those three sections which are physically closest to the subwinding 22. However, the present invention contemplates other arrays of parallelable sections, such as having the parallelable sections disposed on radially opposite ends of the subwindings so that the sections of the parallel segments of one subwinding are those which are physically farthest from the other subwinding.

Constructed similarly to the subwindings 22, 24 are the subwindings 26, 28 from which a plurality 54 and a plurality 56 of the section leads 6, respectively, extend. These section leads are connectable in electrical parallel by a suitable connector means 58. Those sections which are connected in parallel define a parallel segment 60 in the subwinding 26 and a parallel segment 62 in the subwinding 28. Because of these similar elements, the third winding including the subwindings 26, 28 will not be further described. It is to be noted that the present invention contemplates one or more windings disposed between the split portions of the outer winding so that in other embodiments of the present invention the subwindings 26, 28 may be deleted or duplicated so that one, two, or more windings may be disposed between the portions 18, 20. Furthermore, each interior winding may include more than two subwindings. For example, an interior winding may include three subwindings, each of which is radially disposed relative to the others, that are interconnectable in a manner similar to that shown in U.S. Pat. No. 4,255,734 to Owen.

By constructing the transformer of the present invention so that one type of winding (e.g., primary) is split and disposed so that another type of winding (e.g., secondary) is in between the portions of the split winding, a transformer which has leakage reactances that are closer to being equal than those of the transformer disclosed in U.S. Pat. No. 4,160,224 is provided. Because the leakage reactances are closer to being equal, the losses are not as great as in the transformer disclosed in U.S. Pat. No. 4,160,224. Such an improved transformer is provided because the paralleled sections of the subwindings of the interior windings are equal total distances from the outer winding That is, for the embodiment illustrated in FIG. 4, the parallel segment 50 defined by the paralleled sections of the subwinding 22 is the same total radial distance from the primary winding defined by the portions 18, 20 as is the parallel segment 52 defined by the paralleled sections of the subwinding 24. This equivalence can be mathematically stated using the dimensions shown in FIG. 4. In FIG. 4, $A_1$ is the shortest distance the parallel segment 50 is spaced from the winding portion 18, and $A_2$ is the shortest distance the parallel segment 50 is spaced from the winding portion 20. The parallel segment 52 is spaced a minimum distance $B_1$ from the winding portion 18 and is spaced a minimum distance $B_2$ from the winding portion 20. Because the thicknesses of the parallel segments 50, 52 are equal, $A_1+A_2=B_1+B_2$. It is to be noted that "shortest" and "minimum" are to be interpreted with reference to a preselected parallel segment and not with reference necessarily to the absolute shortest or minimum distance between the windings in a transformer. "Shortest" and "minimum" can be considered as the distance measured along a perpendicular between the respective boundaries of the measurement. With reference to FIG. 4 this is the left and right, or radial, line of measurement.

This equal total distance relationship can be stated with reference to lines bounding the areas of the parallel segments 50, 52, which areas are defined by the aforementioned plane passing between the inner and outer sections 18, 20. These boundary lines are spaced respective distances as previously defined by the dimensions $A_1$, $A_2$, $B_1$ and $B_2$. In the preferred embodiment these distances are measured along a line extending perpendicular to the axial direction and including the center points of the corresponding areas of the parallel segments.

It is to be noted that the parallel segments 50, 52 (and the parallel segments 60, 62) are not each equidistant from both of the windings 18 and 20, but both are spaced equal total distances from the entire first winding defined by both portions 18, 20. For example, the segment 50 is not the same distance from the portion 18 as it is from the portion 20; however, the sum of these two distances equals the sum of the distances by which the segment 52 is spaced from the two first winding portions.

In addition to the windings being disposed relative to each other and the connector means 48 and 58 interacting with the windings in the aforementioned manner so that the leakage reactance differential is reduced in the present invention, the present invention is also constructed so that a force arising from a short-circuit current acts substantially only radially on the windings. That is, through the construction of the present invention, there is achieved a greater short-circuit strength than is exhibited by the transformer disclosed in U.S. Pat. No. 4,160,224. This greater short-circuit strength arises from short-circuit forces acting in the present invention in a suhstantially radial direction as opposed to an axial direction. By limiting the short-circuit forces to a substantially radial direction, the transformer can be more easily constructed to resist these forces. For example, the wrapping of the electrical conductors of the winding in concentric convolutions has an inherent strength which tends to resist radially outward short-circuit forces. Radially inward forces are resisted by the support provided by the core 2.

This superiority in short-circuit strength of the present invention over the transformer disclosed in U.S. Pat. No. 4,160,224 will be more fully described with reference to FIGS. 5 and 6.

Figure 5:
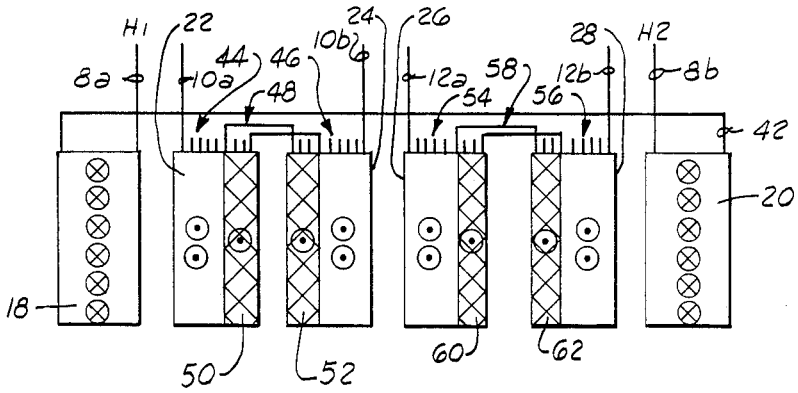
FIG. 5 is a diagram of the windings schematically showing short-circuit currents.

The present invention as schematically illustrated in FIG. 5 includes symbols designating current in each of the windings and the parallel and series portions thereof. Each circle with an "X" in it indicates a current having a direction into the sheet of the drawing, and each circle having a dot in it indicates a corresponding current having a direction out of the sheet of the drawing. Thus, in FIG. 5 the winding portion 18 has six currents into the page and the winding comprising the subwindings 22, 24 has six currents out of the page, the six currents being distributed two in the serial portion of the subwinding 22, one in the parallel segment 50, one in the parallel segment 52 and two in the series portion of the subwinding 24. Although this is a simplified illustration of the actual physical phenomenon which occurs in the transformer during a short-circuit, it is believed satisfactory to illustrate the distinction between the present invention and the transformer shown in U.S. Pat. No. 4,160,224.

In general, there are created between oppositely flowing currents repulsive forces which have magnitudes directly proportional to the square of the current magnitude and inversely proportional to the square of the distance separating the currents. With the distribution of currents as shown in FIG. 5, the repulsive forces which exist between the current in the winding portion 18 and the current in the subwindings 22, 24 act substantially radially due to the strictly radial disposition of the winding portions and subwindings relative to each other. This is to be contrasted with the axially spaced, radially offset configuration of the prior art transformer illustrated in FIG. 6.

Figure 6:
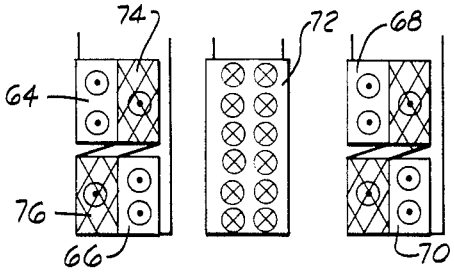
FIG. 6 PRIOR ART
FIG. 6 is a schematic diagram of a portion of the prior art transformer disclosed in U.S. Pat. No. 4,160,224.

In FIG. 6, the subwindings are axially spaced side-by-side. Related subwindings are identified in FIG. 6 by the reference numerals 64, 66 and 68, 70. The subwindings are radially spaced from a first winding 72. Within each subwinding there is defined a corresponding parallel segment; however, in the prior art transformer the segments which are paralleled are radially offset from the first winding 72. For example, a parallel segment 74 of the subwinding 64 is radially closer to the first winding 72 than is a parallel segment 76 of the subwinding 66. This disposition causes the illustrated opposing short-circuit currents to create forces having axial components which are greater than those (if any) of the present invention illustrated in FIG. 5.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A transformer, comprising:

first winding means for providing a first transformer winding, said first winding means including a first portion and a second portion; and second winding means for providing a second transformer winding, said second winding means including a plurality of subwindings, each of said subwindings having a plurality of sections selectively connectable in electrical series-parallel-series with the sections of another of said subwindings so that a first parallel segment and a second parallel segment are defined when at least two of said sections are connected in electrical parallel, said second winding means disposed in inductive relationship with said first winding means wherein said second winding means and said first and second parallel segments thereof are entirely between said first portion and said second portion of said first winding means so that said first parallel segment and second parallel segment are equally spaced from said first winding means.

2. A transformer as defined in claim 1, wherein:

said transformer further comprises a core;

said first winding means includes a first electrical conductor extending about said core in a direction;

said second winding means includes:

a second electrical conductor positioned concentrically about said first electrical conductor in said direction, said second electrical conductor defining a first one of said subwindings; and a third electrical conductor positioned concentrically about said second electrical conductor in said direction, said third electrical conductor defining a second one of said subwindings; and said first winding means further includes:

a fourth electrical conductor postioned concentrically about said third electrical conductor in said direction; and means for electrically connecting said first electrical conductor and said fourth electrical conductor.

3. A transformer as defined in claim 2, wherein:

said second electrical conductor has said first parallel segment defined therein when at least two of said sections are connected in parallel;

said third electrical conductor has said second parallel segment defined therein when at least two of said sections are connected in parallel; and said first parallel segment and said second parallel segment have equal radial lengths.

4. A transformer, comprising:

a first winding having two, and only two, portions including a first portion and a second portion spaced outwardly from, but electrically connected with, said first portion;

a second winding disposed between said first and second portions of said first winding, said second winding including:

a first subwinding having a first plurality of sections; and a second subwinding having a second plurality of sections, said second subwinding disposed closer than said first subwinding to said second portion of said first winding, and said first subwinding disposed closer than said second subwinding to said first portion of said first winding; and connecting means for selectably connecting at least one of said first plurality of sections in electrical parallel with at least one of said second plurality of sections, wherein the only sections connected in electrical parallel are sections which are within said second winding and which are between said first and second portions of said first winding.

5. A transformer as defined in claim 4, wherein:

said first subwinding includes a first electrical conductor disposed in a plurality of turns so that each of said first plurality of sections is defined by an equal number of said turns; and said second subwinding includes a second electrical conductor disposed in a plurality of turns so that each of said second plurality of sections is defined by a number of turns equal to the number of turns in each of said first plurality of sections.

6. A transformer as defined in claim 5, wherein each of said sections of said first and second pluralities of sections has a substantially equal thickness.

7. A transformer as defined in claim 6, wherein said first portion, said second portion, said first subwinding and said second subwinding are radially disposed, but not axially spaced, relative to each other.

8. A transformer as defined in claim 7, further comprising a third winding disposed between said first winding and said second winding so that the shortest distance the sections of said first subwinding connected in electrical parallel by said connecting means are spaced from said first and second portions of said first winding equals the shortest distance the sections of said second subwinding connected in electrical parallel by said connecting means are spaced from said first and second portions of said first winding.

9. A transformer, comprising:

a core;

a first winding including a first portion and a second portion electrically connected to said first portion, said first portion disposed adjacent said core;

a first subwinding disposed concentrically around and adjacent said first portion of said first winding, said first subwinding having a first plurality of sections defined therein;

a second subwinding disposed concentrically around and adjacent said first subwinding and concentrically within said second portion of said first winding, said second subwinding having a second plurality of sections defined therein; and means for selectably connecting ones of said first and second pluralities of sections, and only ones of said first and second pluralities of sections, in electrical parallel, said paralleled sections being radially diposed relative to, and concentric with, each other so that a force arising from a short-circuit current acts substantially only radially on said subwindings.

10. A transformer as defined in claim 9, wherein said paralleled sections are defined by a first parallel segment including at least one of said first plurality of sections and by a second parallel segment including at least one of said second plurality of sections, said first parallel segment being disposed within said first subwinding and said second parallel segment being disposed within said second subwinding so that both of said segments are spaced substantially equal total distances from said first winding.

11. A transformer as defined in claim 10, wherein said first winding and said first and second subwindings are wound codirectionally around said core.

12. A transformer, comprising:

a first electrical conductor wrapped about itself in radially extending layers;

a second electrical conductor wrapped about itself in radially extending layers, said second electrical conductor disposed radially outwardly of said first electrical conductor and having a first plurality of sections defined radially therein, at least one of said first plurality of sections defining a first parallel segment;

a third electrical conductor wrapped about itself in radially extending layers, said third electrical conductor disposed radially outwardly of, and adjacent to, said second electrical conductor and having a second plurality of sections defined radially therein, at least one of said second plurality of sections defining a second parallel segment;

a fourth electrical conductor wrapped about itself in radially extending layers, said fourth electrical conductor disposed radially outwardly of said third electrical conductor;

means for electrically connecting said first and fourth electrical conductors; and wherein said second parallel segment is directly connected in electrical parallel with said first parallel segment so that neither said first parallel segment nor said second parallel segment is equidistant from both said first electrical conductor and said fourth electrical conductor, but the sum of the distances by which said first parallel segment is radially spaced from said first and fourth electrical conductors equals the sum of the distances by which said second parallel segment is radially spaced from said first and fourth electrical conductors, wherein those of said first plurality of sections included in said first parallel segment are physically closest to those of said second plurality of sections included in said second parallel segment.

13. A transformer as defined in claim 12, wherein said first, second, third and fourth electrical conductors are codirectionally wrapped.

14. A transformer as defined in claim 13, further comprising means, upon which said first electrical conductor is mounted, for enhancing the inductive coupling of said first, second, third and fourth electrical conductors.

15. A transformer as defined in claim 12, further comprising means, upon which said first electrical conductor is mounted, for enhancing the inductive coupling of said first, second, third and fourth electrical conductors.

16. A transformer as defined in claim 12, wherein:

said second electrical conductor includes an electrically conductive sheet; and said third electrical conductor includes another electrically conductive sheet.

17. A transformer as defined in claim 16, wherein said first, second, third and fourth electrical conductors are codirectionally wrapped.

18. A transformer, comprising:

a core;

a first electrical conductor disposed in convolutions around said core;

a second electrical conductor disposed in convolutions around said first electrical conductor;

a third electrical conductor disposed in convolutions around said second electrical conductor;

a fourth electrical conductor disposed in convolutions around said third electrical conductor;

means for electrically connecting said first electrical conductor with said fourth electrical conductor; and means for directly connecting the convolutions of said second and third electrical conductors together in a series-parallel-series electrical configuration, wherein selectable ones of the convolutions of said second and third electrical conductors are connected in electrical parallel so that a first parallel segment of said second electrical conductor and a second parallel segment of said third electrical conductor are defined, said first and second parallel segments having first and second areas, respectively, defined by a plane extending between said first and fourth electrical conductors, said first area being bounded within the plane by a first line coextensible with one radial limit of said first parallel segment and a second line coextensive with the other radial limit of said first parallel segment, said first line being spaced from said first electrical conductor by a first distance and said second line being spaced from said fourth electrical conductor by a second distance, and said second area being bounded within the plane by a third line coextensive with one radial limit of said second parallel segment and a fourth line coextensive with the other radial limit of said second parallel segment, said third line being spaced from said first electrical conductor by a third distance and said fourth line being spaced from said fourth electrical conductor by a fourth distance, said first and second parallel segments being disposed so that the sum of said first and second distances equals the sum of said third and fourth distances.

19. A transformer as defined in claim 18, wherein the convolutions of said first, second, third and fourth electrical conductors extend co-directionally relative to said core.

20. A transformer as defined in claim 19, wherein the convolutions of said first, second, third and fourth electrical conductors are disposed in concentric layers.

* * * * *